United States Patent [19]
Curley et al.
[11] 4,318,263
[45] Mar. 9, 1982

[54] APPARATUS FOR INSERTING A FILM-WRAPPED PACKAGE INTO A CARTON

[75] Inventors: Edward Curley, Toms River; Herbert S. Muse, Morris Plains, both of N.J.

[73] Assignee: American Can Company, Greenwich, Conn.

[21] Appl. No.: 137,897

[22] Filed: Apr. 7, 1980

[51] Int. Cl.[3] ..... B65B 63/04; B65B 5/04
[52] U.S. Cl. ..... 53/116; 53/252; 53/376
[58] Field of Search ..... 53/252, 258, 376, 170, 53/377, 116

[56] References Cited

U.S. PATENT DOCUMENTS

| | | | |
|---|---|---|---|
| 3,509,681 | 5/1970 | Sass | 53/252 X |
| 3,678,649 | 7/1972 | Clancy | 53/252 X |
| 3,821,874 | 7/1974 | Jones | 53/252 X |
| 3,982,382 | 9/1976 | Vogel | 53/252 |
| 4,244,282 | 1/1981 | Ruzand et al. | 53/376 X |

FOREIGN PATENT DOCUMENTS

| | | | |
|---|---|---|---|
| 2354685 | 1/1978 | France | 53/258 |

*Primary Examiner*—Horace M. Culver
*Attorney, Agent, or Firm*—Robert P. Auber; George P. Ziehmer; Harry W. Hargis, III

[57] ABSTRACT

Apparatus for inserting a film-wrapped package into a carton. A relatively flat film-wrapped package, sealed along a peripherally extending flange that projects away from its contents, is inserted into a carton through an open side having closure flaps. To ensure against interference of the flange with the closure flap upon closing the carton, the package is inserted using a pushing device having a concavely curved face engageable with the package flange, and operative to curl the flange into the carton for frictional retention by a wall of the carton.

10 Claims, 6 Drawing Figures

APPARATUS FOR INSERTING A FILM-WRAPPED PACKAGE INTO A CARTON

BACKGROUND OF THE INVENTION

This invention relates to packaging apparatus, and especially to apparatus for inserting a film-wrapped package into a carton in such a manner as to facilitate its closure.

Heretofore in the art of inserting flat, film-wrapped packages of bacon into flat cartons, it has been a practice to engage the sealed peripheral flange of such a package with the flat face of a pushing device or ram and push the package horizontally into an open, horizontally positioned carton. Problems have arisen, however, in that pushing against the flange causes it to fold upon itself so that when the flat face of the pushing device is retracted, the folded flange springs outwardly, often to a position interfering with closing the carton by provided closure flaps.

It is a general objective of the present invention to provide improved apparatus of the foregoing type affording predetermined and controlled positioning of a package flange so that it does not interfere with closure of a carton into which the package has been inserted.

It is a more general objective to provide improved carton filling apparatus enhancing its reliability and economy of operation.

SUMMARY OF THE INVENTION

In achievement of the foregoing as well as other objectives, the invention contemplates improved apparatus for inserting a film-wrapped package, having a peripherally extending sealing flange, into an open carton, comprising: means for supporting a carton having at least one open side presented in a predetermined direction; means supporting said package for insertion into said open carton; and means for pushing said package to insert it into said carton, including a ram having an elongate, concavely curved surface positioned with its longitudinal axis of curvature generally parallel to said sealing flange, said ram being movable toward said package and operative to engage said sealing flange with said concavely curved surface to push said package into said carton and to curl said flange into frictional engagement with a wall of said carton.

The manner in which the foregoing as well as other objectives and advantages of the invention may best be achieved will be more fully understood from a consideration of the following description taken in light of the accompanying drawing.

DESCRIPTION OF THE PREFERRED EMBODIMENT

Figure 1:
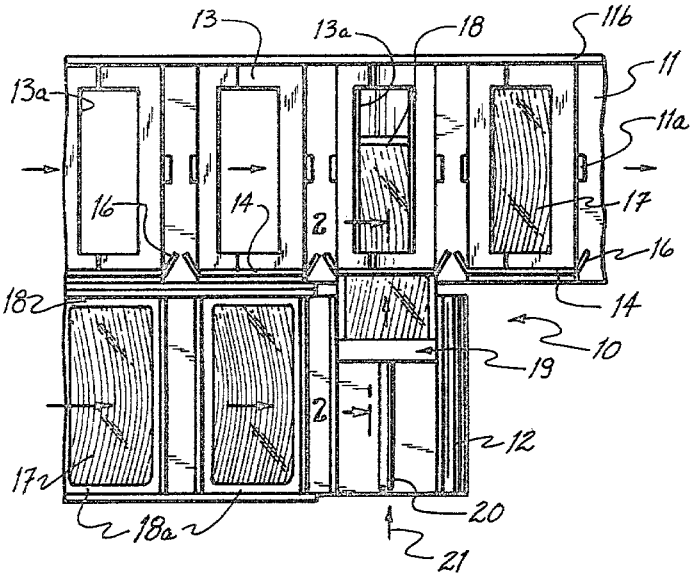
FIG. 1 is a fragmentary top plan view of carton filling apparatus embodying the invention.

With more detailed reference to the Drawing, and first to FIG. 1, a carton filling apparatus 10 includes parallel conveyors 11 and 12. Conveyor 11 is of conventional construction, and is positioned and operative to transport and present at a loading station a relatively flat rectangularly shaped carton 13 with at least one open side provided with closure flaps 14, 15 and 16 maintained in the illustrated opened position. While the walls of carton 13 may be solid, we have chosen one with a top opening 13*a*, for convenience of illustration alone. Conveyor 12 is also of conventional construction, and is positioned and operative to transport and present at the loading station, opposite the open side of carton 13, a relatively flat, rectangularly shaped film-wrapped package 17 having a peripherally extending sealing flange 18. At the loading station, package 17 is supported for sliding insertion into the carton. As is the usual practice, flange 18 is disposed substantially in the plane of the bottom of package 17 which rests on conveyor 12.

Insertion of the package 17 is achieved by means for pushing against an end section 18*a* of flange 18, including a reciprocably movable ram or pushing device 19 on a push rod 20 operated by known mechanism designated generally by the numeral 21, and indicated diagramatically by directional arrows.

Figure 2:
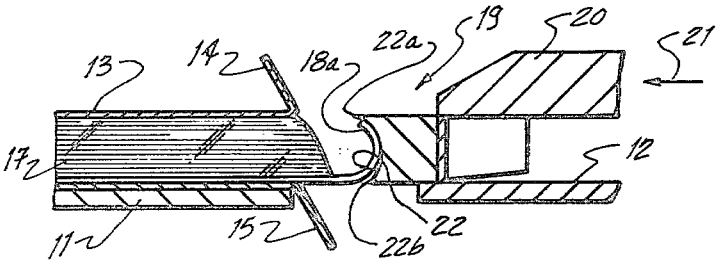
FIG. 2 is a fragmentary sectional view taken generally along the line 2—2 in FIG. 1, looking in the direction of arrows applied thereto.
Figure 3:
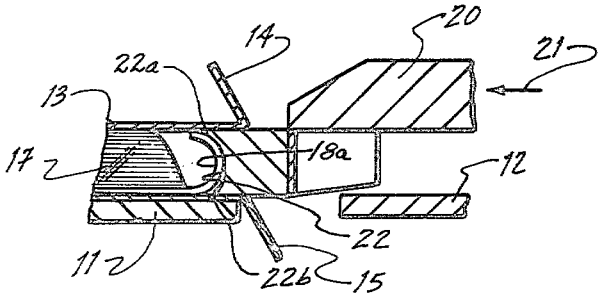
FIG. 3 is a view similar to FIG. 2, and illustrating an operational feature of the invention.

In especial accordance with the invention, ram 19 comprises a generally rectangularly shaped block having an elongate, concavely curved face or surface 22, preferably of generally cylindrical curvature, in a lateral portion thereof, and positioned with its longitudinal axis of curvature generally parallel to and presented toward section 18*a* of sealing flange 18. The ram 19 is movable toward package 17, and, as is seen in FIG. 2, is operative to cause the concavely curved surface 22, in the region of its lower terminal edge portion 22*b*, to engage section 18*a* of the sealing flange to push package 17 into carton 13. Insertion of the package 17 is accompanied by abutting engagement of a flange section opposite section 18*a* (not shown) with the opposite, closed end of the carton, and, as is seen in FIG. 3, is followed by the curling of flange section 18*a* by surface 22 into frictional engagement with the interior surface of the top wall of carton 13.

To facilitate sliding insertion of the package, and in accordance with known practice, fingers 11*a* on conveyor 11 are operative as seen in FIG. 1 slightly to compress carton 13 and flex its top wall slightly upwardly. Position of the carton for insertion of package 17 is established and maintained by cooperative disposition of fingers 11*a* and a stationary wall 11*b* parallel to the line of travel of conveyor 11 and over which the closed end of the carton slides.

Figure 4:
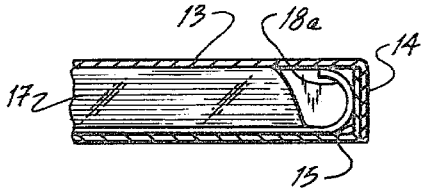
FIG. 4 is a sectional view of the filed carton seen in FIG. 3, with flaps secured in closed position.

Upon insertion of package 17 into carton 13, ram 19 is retracted and the filled carton is advanced to suitable flap closing and gluing means of conventional design, in achievement of a closed carton as is seen in FIG. 4.

Typically, package 17 comprises bacon, in shingled slices, vacuum packed between a pair of transparent, gas impermeable, polymeric films that are hermetically sealed along their edges to form peripherally extending sealing flange 18. Film comprising laminae of nylon and ethylene vinyl acetate from about 2½ mils to about 3½ mils thick typically is used for packages of this type. For such a package-carton combination, the flange section 18*a*, prior to initiation of curling, extends from about ¾ inch to about 1 inch beyond the main body portion of the package as well as slightly beyond the open end of carton 13. Since the carton is about ⅝ inch high, the ¾ to 1 inch package flange is readily curled to engage the carton.

We have found that a concavely curved surface 22 comprising a sector of a cylinder of about ¾ inch diameter in a block about ⅝ inch high, and, as is seen in FIGS. 1 and 2, with its upper terminal edge portion 22*a* parallel to and projecting about 3/16 inch beyond the lower terminal edge portion 22*b* in the direction of movement, readily curls a flange 18*a* into the carton, preferably into frictional engagement with the carton wall to ensure positive retention. Further to the construction of ram 19, we have found that an acetal resin available under the trademark "Delrin" performs well mechanically, also inhibiting generation of static electricity.

While in the disclosed embodiment the concavely curved surface 22 is operative to curl a lower disposed flange section 18*a* upwardly, it is to be understood that flange sections may be curled downwardly. The desired direction of curl is of course generally determined by selective disposition of the flange above or below the center of curvature of cylindrically curved surface 22. In either event, it is important that the line of flange engagement with the curved surface be sufficiently spaced above or below, either directly or also to the right of, the center of curvature to initiate and sustain curling of the flange. Stated another way, it is contemplated that the concavely curved surface 22 be movable in a direction perpendicular to its axis of curvature, and that it engage the flange 18*a* along a line intermediate one of edges 22*a* or 22*b* and the line of tangency to surface 22 of an imaginary plane perpendicular to the direction of movement of ram 19.

Figure 5:
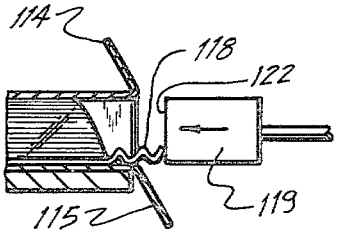
FIG.5 (PRIOR ART)
FIGS. 5 and 6 are showings similar to FIGS. 3 and 4, respectively, and illustrating prior art apparatus over which the present invention is an improvement.
Figure 6:
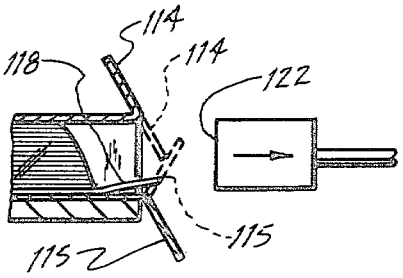
FIG.6 (PRIOR ART)

Advantages achieved by the improved filling apparatus will be more fully appreciated when it is seen from the prior art showings of FIGS. 5 and 6 that a ram 119 with a flat face 122 pushes the flange section 118*a* into a random shape (FIG. 5), for example a corrugated configuration, from which it is free to spring back to interfere with closure of flaps 114 and 115 (i.e. broken line showings thereof) at the closure station.

While a preferred embodiment of the invention has been described, it will be understood that it is susceptible of such modifications as may fall within the scope of the appended claims.

We claim:

1. In an apparatus for inserting a generally rectangular package wrapped in flexible film and having a peripherally extending flange into a carton having an opening, including means for supporting said carton with said opening presented in a predetermined direction, means for supporting said package for insertion into said carton through said opening, and means for pushing said package into said carton while supported for said insertion, the improvement wherein said means for pushing comprises ram structure including an elongate, concavely curved surface coextensive with the flange extending along one side of said package and positioned with its longitudinal axis of curvature generally parallel to said flange on said one side, said ram structure being movable toward said package and operative to engage said concave surface with said flange to push said package into said carton and to curl said flange into said carton.

2. Apparatus of claim 1, wherein said concavely curved surface is of generally cylindrical shape.

3. Apparatus of claim 1 or 2, wherein said means for pushing is operative to curl said flange into frictional engagement with an interior surface of said carton.

4. Apparatus of claim 1 or 2, wherein said means for supporting said carton is constructed and arranged to present said opening horizontally, and said means for supporting said package is constructed and arranged to slide said package horizontally into said carton.

5. Apparatus of claim 3, wherein said means for supporting said carton is constructed and arranged to present said opening horizontally, and said means for supporting said package is constructed and arranged to slide said package horizontally into said carton.

6. Apparatus of claim 2, wherein said concave surface terminates in upper and lower edge portions, above and below the axis of curvature of said surface, respectively, and said surface is movable in a direction perpendicular to said axis and engages said flange along a line intermediate one of said edge portions and the line of tangency to said surface of a plane perpendicular to the recited direction of movement.

7. Apparatus of claim 3, wherein said concave surface terminates in upper and lower edge portions, above and below the axis of curvature of said surface, respectively, and said surface is movable in a direction perpendicular to said axis and engages said flange along a line intermediate one of said edge portions and the line of tangency to said surface of a plane perpendicular to the recited direction of movement.

8. In an apparatus for inserting a package wrapped in flexible film, and having a peripherally extending sealing flange, into a carton having an opening, means for supporting said package for insertion into said carton through said opening, and means for pushing said package into said carton while supported for insertion, the improvement wherein said means for pushing comprises structure defining a concavely curved surface positioned with its axis of curvature generally parallel to said flange of a supported package, said structure being movable toward such package and operative to engage said concave surface with said flange to push said package into said carton and to curl said flange into the carton.

9. Apparatus of claim 8, wherein said concave surface is of generally cylindrical curvature.

10. In an apparatus for inserting into a carton having a generally rectangular opening, a relatively flat package of generally rectangular configuration wrapped in flexible film and having a sealing flange disposed substantially in the plane of a surface of said package, the width of said flange exceeding the height of said opening, including means for supporting said carton with said opening presented in a predetermined direction, means for supporting said package for insertion into said carton through said opening, and means for pushing said package into said carton through said opening while supported for said insertion, the improvement wherein said means for pushing comprises ram structure including an elongate, concavely curved surface coextensive with said flange positioned with its longitudinal axis of curvature generally parallel to said flange, said surface terminating in parallel edge portions, one of said edge portions projecting beyond the other of said edge portions in the direction of movement of said ram, said ram structure being movable toward said package and operative to engage said concave surface, in the region of said other edge portion, with said flange to push said package through said opening into said carton and to curl said flange into frictional engagement with the inner surface of a carton wall.

* * * * *